United States Patent [19]

Bates

[11] 3,994,024

[45] Nov. 30, 1976

[54] CATCHER'S MITT WRIST PROTECTOR

[75] Inventor: Richard E. Bates, Ashland, Ky.

[73] Assignee: Wilson Sporting Goods Co., River Grove, Ill.

[22] Filed: May 21, 1975

[21] Appl. No.: 579,608

[52] U.S. Cl. ..... 2/19

[51] Int. Cl.[2] ..... A41D 13/10

[58] Field of Search ..... 2/16, 19, 159, 160, 2/161 R, 161 A, 162, 170; 294/25

[56] References Cited

UNITED STATES PATENTS

| | | | |
|---|---|---|---|
| 811,389 | 1/1906 | Ferry | 2/19 |
| 963,006 | 6/1910 | King | 2/19 |
| 1,045,232 | 11/1912 | Whitley | 2/19 |
| 1,602,027 | 10/1926 | Kennedy | 2/19 |
| 1,807,402 | 5/1931 | Gillian | 2/162 |
| 3,597,765 | 8/1971 | Stanton | 2/159 |
| 3,712,623 | 1/1973 | Donnald | 2/170 X |

FOREIGN PATENTS OR APPLICATIONS

| | | | |
|---|---|---|---|
| 172,823 | 12/1921 | United Kingdom | 2/16 |

*Primary Examiner*—Werner H. Schroeder
*Assistant Examiner*—Moshe I. Cohen
*Attorney, Agent, or Firm*—Hill, Gross, Simpson, Van Santen, Steadman, Chiara & Simpson

[57] ABSTRACT

A baseball catcher's mitt is provided with a tongue-like wrist protector pad flap. The mitt has a back piece and a mitt piece and is provided with a hand-receiving opening adjacent to which is a heel pad. The wrist protector flap is in the form of a generally flat pad which extends away from the heel pad at the palm side of the hand-receiving opening. Stitching and/or lacing means joins the mitt pieces and the wrist protector flap in unitary assembly. A flexible joint for the wrist protector flap is provided at it's juncture with the mitt pieces.

16 Claims, 7 Drawing Figures

CATCHER'S MITT WRIST PROTECTOR

BACKGROUND OF THE INVENTION

Field of the Invention

The present invention relates to a catcher's mitt having a wrist protector pad flap which may be integrally or optionally attached thereto for the purpose of protecting the wrist and heel of the hand from abuse such as may be caused by foul tips.

In the past, baseball mitts have not been provided with satisfactory means for protecting the wrist and heel of the hand of the wearer. According to U.S. Pat. No. 811,389, a wrist band for a catcher's mitt is proposed but this interferes with wrist motion and otherwise interferes with maneuverability of the glove. Another form of catcher's mitt with wrist protector sleeve is shown in U.S. Pat. No. 1,602,027, but is subject to shortcomings similar to the U.S. Pat. No. 811,389 construction. Also, certain types of hockey gloves have been provided with wrist padding such as generally shown in U.S. Pat. No. 1,130,895, but such wrist padding does not lend itself for use with a catcher's mitt.

An important object of this invention is to provide a new and improved catcher's mitt and wrist protector adapted to be secured thereto for protecting the wrist and heel of the wearer's hand from abuse from foul tips and the like.

Still another object of this invention is to provide a wrist protector of a type which can be integrally attached to a catcher's mitt at the factory.

Yet another object of this invention is to provide a wrist protector which can be readily assembled with an existing catcher's mitt by a user.

A further object of this invention is to provide a wrist protector so constructed and applied as not to restrict wrist motion or otherwise interfere with freedom of maneuverability.

A still further object of this invention is to provide a wrist protector which can be assembled with a catcher's mitt without necessity for any alteration of normal manufacturing procedures.

According to important features of this invention, a baseball catcher's mitt is provided with a tongue-like wrist protector pad flap. The mitt may be of the type having back and palm pieces and provided with a hand-receiving opening. Each mitt piece has a cut-out area matched with the other and bounded by a thumb section, a pocket section and a finger section, there being a web with web lacing means joining the web with the thumb and finger sections. The pocket section has a heel section adjacent to the opening end. padding between the pieces includes a heel pad of substantial thickness. The generally flat wrist protector pad flap is positioned to extend away from the heel pad in adjacency to the hand-receiving opening. Stitching and/or lacing means join the wrist protector pad in functioning assembly with the palm face of the heel pad of the mitt. A flexible hinge for the wrist protector flap is provided at juncture of the wrist protector with the mitt. By virtue of the substantial thickness of the heel pad, the protector pad flap is supported substantially spaced from the wrist during normal play and permits free wrist movement relative to the flap while providing efficient wrist protection.

BRIEF DESCRIPTION OF THE DRAWINGS

Other objects, features and advantages of the invention, together with its organization, construction and operation will be best understood from the following detailed description of preferred embodiments of the invention, taken in conjunction with the accompanying drawings, on which.

DESCRIPTION OF A PREFERRED EMBODIMENT

Figure 1:
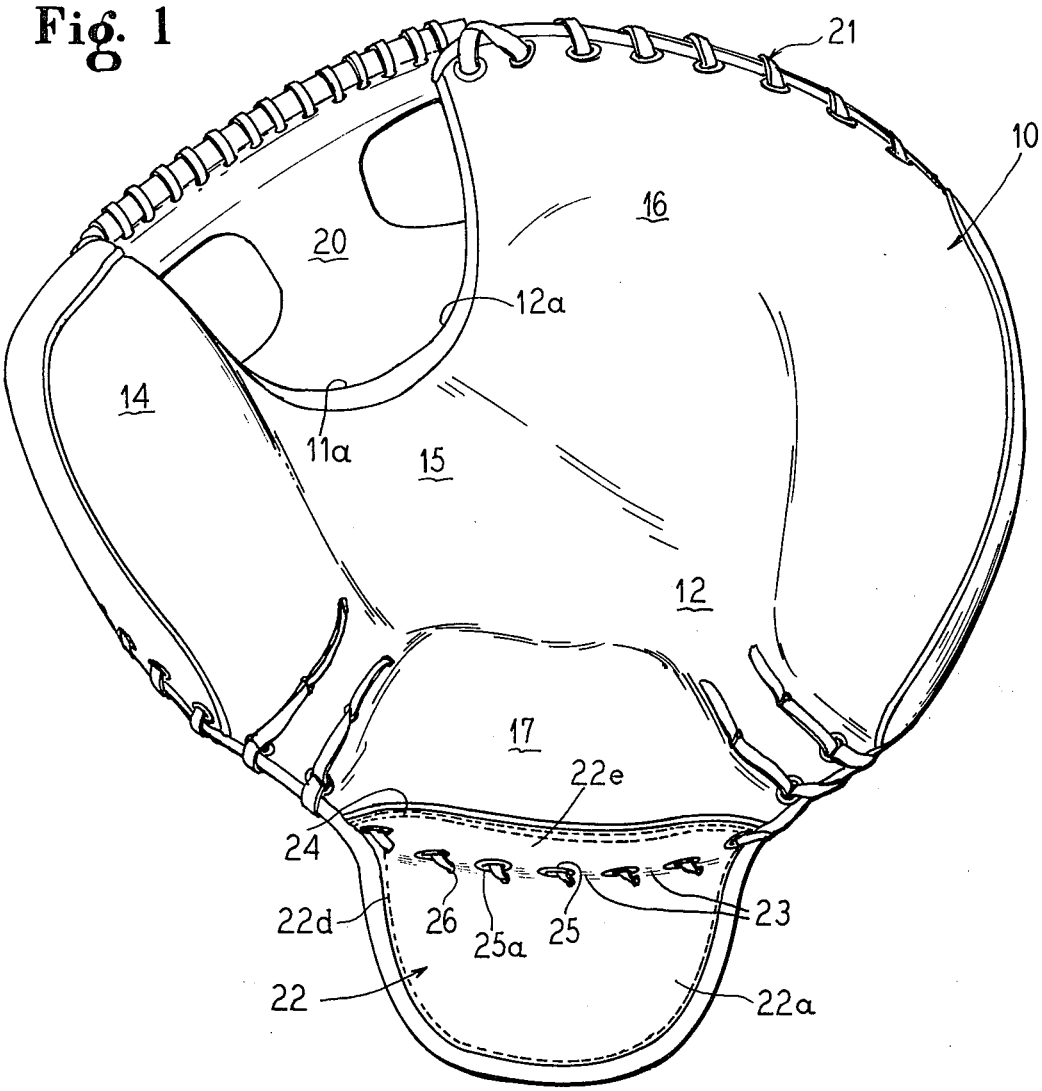
FIG. 1 is a palm face view of a catcher's mitt having a wrist protector pad flap embodying important features of this invention.

A catcher's mitt 10 of the kind with which the present invention is especially useful comprises a mitt back piece 11 and a mitt palm piece 12, having respective cut-out areas 11*a*. The mitt 10 has among other things an open hand receiving end 13 for receiving a user's hand H (FIG. 3); and includes a thumb section 14, a pocket section 15, a finger section 16, and a heel section 17, all as seen in FIG. 1. The heel section or heel pad 17 is provided with padding 18 (FIG. 4) to protect the heel of the user's hand. In addition the mitt 10 has a web 20 located between the thumb section 14 and the finger section 16 as seen in FIG. 1. All of the mitt pieces or sections 11, 12, 14, 15, 16, 17 and 20 are joined into a unitary assembly in a more or less conventional way by means of stitching and lacing 21 the ends of which may be tied at any one or more suitable points.

Figure 2:
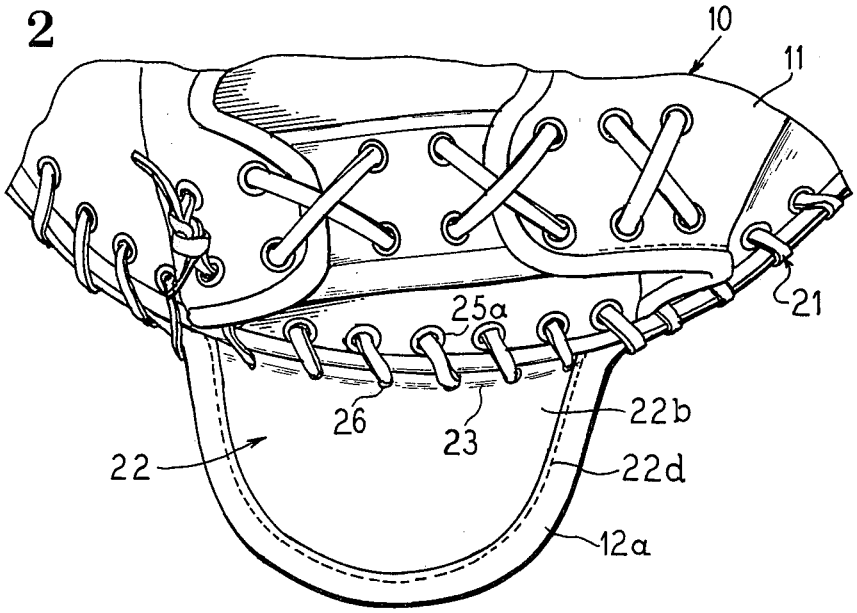
FIG. 2 is an enlarged fragmentary back plan view of the catcher's mitt shown in FIG. 1.
Figure 4:
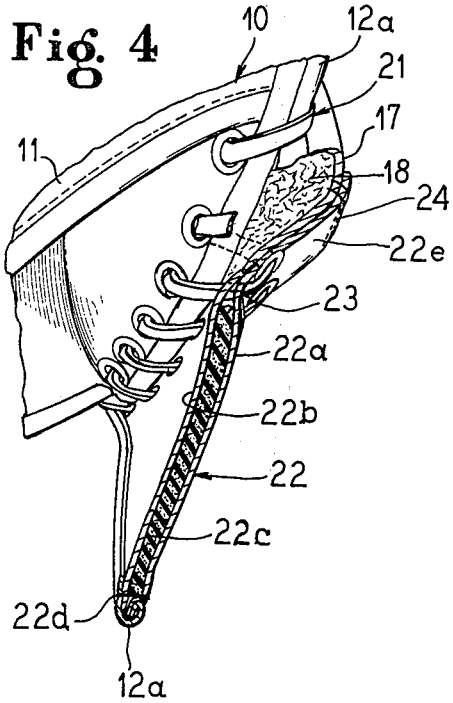
FIG. 4 is an enlarged fragmentary side edge view with portions of the protector shown in section.

According to important features of this invention, a cushioned tongue-like wrist protector pad flap 22 is provided for attachment to the mitt. The flap 22 comprises a pair of pieces of leather 22*a* and 22*b* and a cushioning pad 22*c* therebetween. The pad 22*c* can be made of any suitable materials such as a snythetic foam, e.g. the type sold under the trade name "Ensolite", and can have a thickness of the order of one-quarter inch. In one desirable form the flap 22, may be secured at it's side and distal edges as by means of stitching 22*d* to and within a finishing binding edging strip 12*a* of the mitt piece 12 (FIGS. 2 and 4). The flap 22 is generally flat in it's face plane, is arcuately shaped at it's free or distal end, is generally aligned with the opening 13 and is of sufficient length and width to cover a normal size wrist.

According to other important features of this invention, the wrist protector flap 22 has a flexible hinge joint 23 with the mitt 10, generally at the area of their attachment as shown in FIG. 1. This flexible joint 23 is provided so that the flap 22 can freely flex relative to the mitt and not restrict motion of the user's wrist. The flexible action of the wrist protector 22 to assume different positions is demonstrated by the full and dotted line showing in FIG. 3.

Where the protector flap 22 is assembled with the mitt 10 at the factory it may be permanently attached to the mitt, as by means of stitching 24 securing the proximal end extension portion 22*e* of the flap 22 to the outer face of the heel section 17 of the mitt and more particularly to the mitt piece 12.

Figure 3:
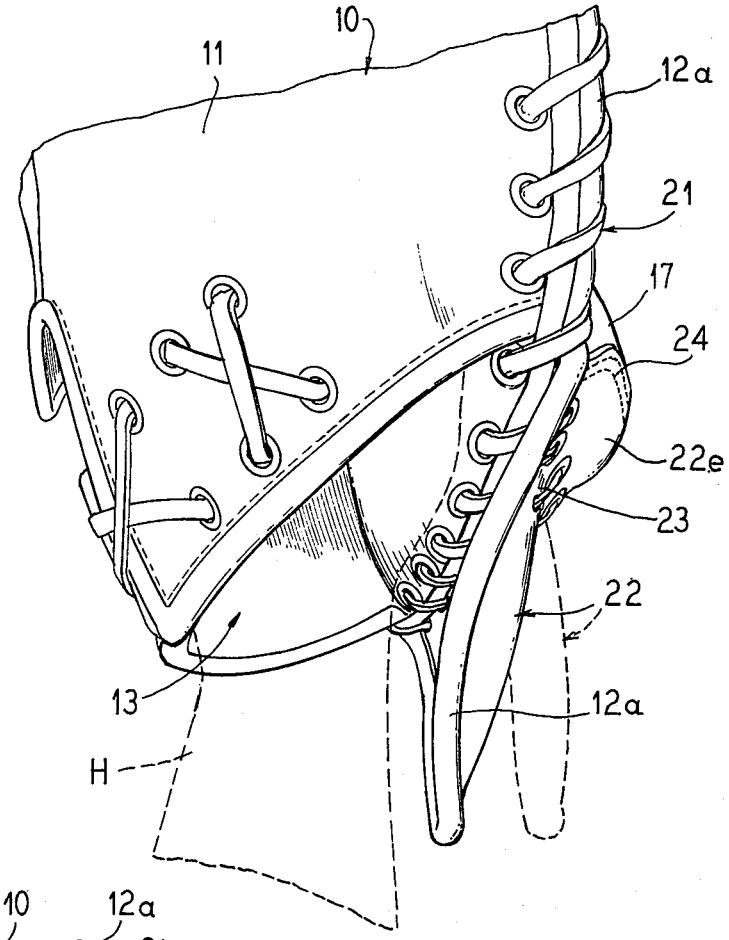
FIG. 3 is an enlarged fragmentary side elevational view of the catcher's mitt shown in FIG. 1 with the protector in different positions in full and dotted lines.

In order further to facilitate attachment of the wrist protector flap 22 to the mitt 10 without altering normal assembly operations in the manufacture of mitts of this type, the flap 22 is provided with a series of lacing holes 25 in a line in spaced adjacency to it's proximal edge. Each hole 25 is provided with a metal eyelet 25*a*. In close adjacency to the line of holes 25 is a second line series of holes 26. The lines of holes 25 and 26 are disposed in slightly staggered and arcuate alignment relation to facilitate applying the lacing 21 through. In this way the flap 22 can be securely laced to both of the mitt pieces 11 and 12 as is seen in FIGS. 2, 3 and 4. It may be noted that the lacing 21 extends through both of the flap pieces 22*a* and 22*b*, thereby providing a positive but flexible juncture between the flap 22 and the body of the catcher's mitt 10.

Figure 5:
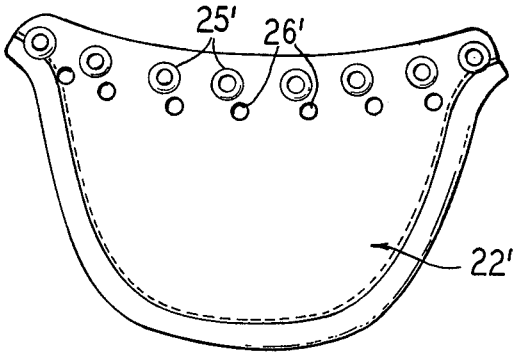
FIG. 5 is a plan view showing one face of a modified protector pad flap which is particularly adapted for attachment by a user to an existing catcher's mitt, the opposite face being substantially the same.

Shown in FIG. 5 is a wrist protector flap 22' which is of substantially the same construction as the pad flap 22. The flap 22' is particularly suited for attachment to an existing catcher's mitt. Thus, a baseball equipment manufacturer may manufacture the flaps 22' as optional equipment for sale through retail outlets. A user may then lace the pad 22' to his own catcher's mitt by untying the knotted ends of the lacing and then relacing through proximal margin aligned series of lacing holes 25' and 26' in much the same way as was described for the flap 22. In this instance, of course, the wrist protector 22' will not be stitched to the heel of the mitt.

Figure 6:
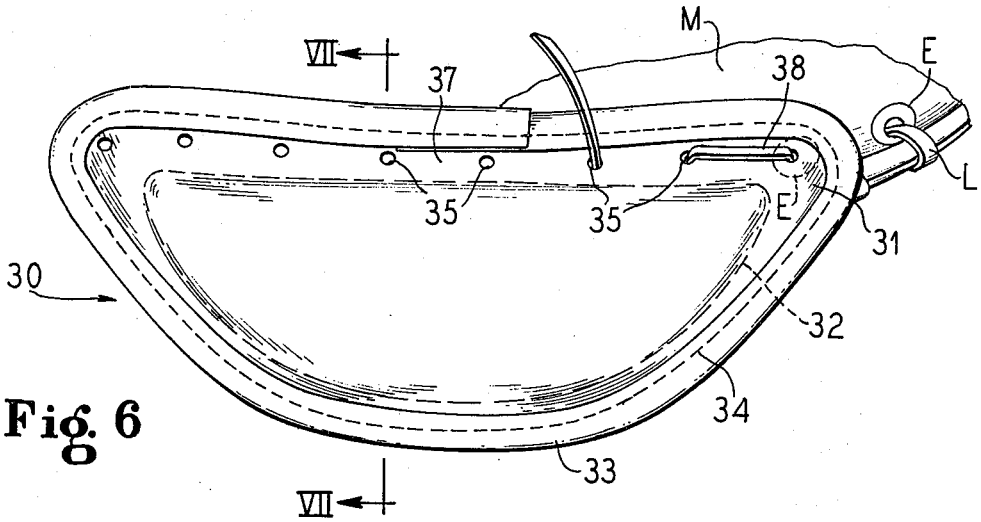
FIG. 6 is a plan view of another modified protector pad flap which is especially suitable for attachment by a user to an existing catcher's mitt, with the opposite face of the pad being substantially the same as the face shown.
Figure 7:
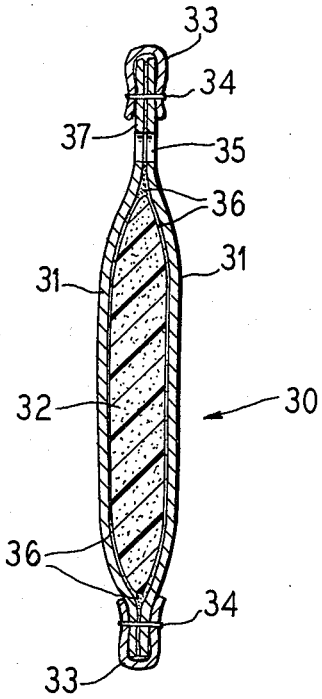
FIG. 7 is an enlarged vertical section through the flap in FIG. 6 taken substantially along the line VII—VII.

In FIGS. 6 and 7 another modification of the wrist protector pad flap 30 is depicted which is much the same as the pad flaps 22 and 22' in that it is of generally flat form and is adapted to be attached in wristprotecting relation adjacent to the palm face at the access opening end of the catcher's mitt. This instance, the pad flap 30 is constructed and arranged to serve as an optional accessory which may be attached to an existing catcher's mitt. In a preferred form, the pad flap 30 comprises a pair of substantially coextensive facing sheets 31 of leather or other suitable material and enclosing therebetween a pad 32 of suitable material such as sponge rubber of somewhat smaller outline so as to leave the joined margins of the facing sheets 31 about the pad 32 free to engage in face-to-face relation and receive a binding strip 33 in enclosing finishing relation about the edges of the facing sheet panels. Fastening of the facing sheet panels 31 together and securement of the binding strip 33 thereto is effected by suitable means such as stitching 34. In a preferred form, the protector flap 30 is at least as long as the flaps 22 and 22', but is substantially wider, with it's proximal end generally straight with only a very slight concave curvature, and then tapering from it's opposite sides toward it's distal end. In it's proximal margin, the flap 30 has, in this instance, a single series of lacing holes 35 in alignment in a row entirely across the maximum width of the flap. This provides for simplified lacing of the flap 30 to the outer side of the heel portion of a catcher's mitt. Inasmuch as the internal pad 32 terminates short of the lacing holes 35, it will be appreciated that the proximal margin of the flap 30 provides an efficient flexible hinge section 37 which in assembly with a catcher's mitt will serve the same function as the previously described flexible hinge joint 23. Adhesive means 36 holds the pad 32 in place.

For attaching either of the flaps 22' or 30 to an existing mitt M (FIG. 6), a simplified procedure involves employing a separate, preferably leather, auxiliary lace 38. To effect lacing attachment to the mitt M, the auxiliary lace 38 may be readily threaded through the flap holes 35 and lacing holes or eyelets E in the wrist end of the palm face piece or assembly of the mitt. The holes E are customarily oversize relative to the regular mitt laces L and thus are not overcrowded so that the auxiliary lace 38 can be easily threaded therethrough alongside the regular mitt laces L.

It will be understood that variations and modifications may be effected without departing from the spirit and scope of the novel concepts of this invention.

I claim as my invention:

1. A baseball catcher's mitt having a back face and a palm face and provided at the palm face with a heel pad of substantial thickness adjacent to a hand-receiving opening into the mitt, and comprising:

a wrist protector pad flap extending away from said heel pad at the palm face side of said opening and at its proximal end being about as wide as said opening;

means securing the flap to the palm face at the heel pad of the mitt adjacent to said opening so that the thickness of the heel pad intervenes between the flap and the opening; and said flap being substantially flat and having a flexible hinge area thereacross adjacent to juncture with the mitt;

whereby the protector pad flap is supported substantially spaced from the wrist during normal play and permits free wrist movement relative to the flap while providing efficient wrist protection.

2. A mitt according to claim 1, wherein said flap has a proximal end extension beyond said hinge area stitched onto the palm face of the mitt contiguous to the heel pad.

3. A mitt according to claim 2, including lacing holes through said hinge area in a row between said stitched-on end extension and the body of the pad.

4. A mitt according to claim 1, wherein said means securing the protector pad flap to the mitt comprise stitching and lacing.

5. A mitt according to claim 1, wherein said protector pad flap has a distal edge which tapers generally arcuately from opposite sides of the flap.

6. A mitt according to claim 5, wherein said flexible hinge area has a plurality of series of lacing holes extending across the width of the flap, and said mitt has lacing along the edge of the mitt face adjacent to said opening, said lacing received through both of said series of holes and attaching the flap to the mitt.

7. A mitt according to claim 1, including edge binding extending along the side and free end edges of the flap.

8. A mitt according to claim 1, including an auxiliary lace securing said flap to the mitt.

9. A mitt according to claim 1, wherein said palm face has a finishing binding edging strip about its edge, said binding edging strip also extending about the side and distal edges of the pad flap, and means securing said binding edging strip to said palm face and to said pad flap.

10. A baseball catcher's mitt, comprising:

a wrist protector pad flap extending away from said heel pad at the palm face side of said opening and at its proximal end being about as wide as said opening, said wrist protector pad flap comprising a pair of facing sheets disposed in face-to-face substantially coextensive relation, a flat cushioning filler pad of substantially uniform thickness between said facing sheets, means securing the facing sheets in enclosing relation to said pad comprising an edge finishing binding strip about at least distal and side edges of the pad flap, stitching securing the binding strip to said edges, a substantial proximal end portion of the facing sheets secured together and extending beyond said filler pad and providing a flexible hinge area across the width of the flap, and a series of lacing holes extending in a row across the width of said flexible hinge area;

and lacing extending through said holes and securing the flap to the palm face of the heel pad of the mitt adjacent to said opening so that the thickness of the heel pad intervenes between the flap and the opening;

whereby the protector pad flap is supported substantially spaced from the wrist during normal play and permits free wrist movement relative to the flap while providing efficient wrist protection.

11. A mitt and wrist protector pad flap according to claim 10, including an extension projecting from said proximal end portion permanently attachment to the mitt.

12. A mitt and wrist protector pad flap according to claim 10, including a plurality of rows of staggered lacing holes for the lacing extending across the width of the flap in said hinge area.

13. A mitt and wrist protector pad flap according to claim 10, said cushioning filler pad being of smaller outline dimensions than said facing sheets and substantially spaced from the edges of the sheets so that the marginal portions of the sheets are in direct face-to-face engagement whereby to facilitate attachment of said binding strip thereto.

14. A mitt and wrist protector flap according to claim 10, including an auxiliary lace for attaching the flap to the mitt by lacing the auxiliary lace through said lacing holes and through lacing holes of the mitt.

15. A mitt and wrist protector pad flap according to claim 10, including adhesive means securing said cushioning filler pad in place between said sheets.

16. A wrist protector pad flap according to claim 10, wherein said extension hinge area is defined by a substantially straight edge beyond said lacing holes, and said edge binding strip extending in finishing relation along said substantially straight edge.

* * * * *